US009233408B2

(12) United States Patent
Asahi

(10) Patent No.: US 9,233,408 B2
(45) Date of Patent: Jan. 12, 2016

(54) HOT FORGING PRESS MACHINE

(71) Applicant: ASAHI FORGE CORPORATION, Nagoya (JP)

(72) Inventor: Shigemitsu Asahi, Mino (JP)

(73) Assignee: ASAHI FORGE CORPORATION, Aichi (JP)

( * ) Notice: Subject to any disclaimer, the term of this patent is extended or adjusted under 35 U.S.C. 154(b) by 246 days.

(21) Appl. No.: 13/960,804

(22) Filed: Aug. 7, 2013

(65) Prior Publication Data

US 2013/0319065 A1 Dec. 5, 2013

Related U.S. Application Data

(63) Continuation of application No. PCT/JP2012/074885, filed on Sep. 27, 2012.

(30) Foreign Application Priority Data

Sep. 29, 2011 (JP) ..... 2011-214128

(51) Int. Cl.
*B21D 28/24* (2006.01)
*B21J 5/10* (2006.01)
(Continued)

(52) U.S. Cl.
CPC . *B21D 28/24* (2013.01); *B21J 5/02* (2013.01); *B21J 5/025* (2013.01); *B21J 5/027* (2013.01); *B21J 5/10* (2013.01); *B21K 1/40* (2013.01)

(58) Field of Classification Search
CPC ..... B21J 5/02; B21J 5/027; B21J 9/00; B21J 9/02; B21J 13/02; B21J 13/03; B21J 5/10; B21J 9/04; B21K 1/40
USPC ..... 72/344
See application file for complete search history.

(56) References Cited

U.S. PATENT DOCUMENTS 1,913,492 A * 6/1933 Lefere ..... 29/894.362
2,411,399 A * 11/1946 Walpole ..... 83/387
3,455,138 A * 7/1969 Zapf ..... 72/405.07
(Continued)

FOREIGN PATENT DOCUMENTS

JP 1-180743 A * 7/1989 ..... B21J 5/02
JP 02-112844 4/1990
(Continued)

OTHER PUBLICATIONS

International Search Report for corresponding International Application No. PCT/JP2012/074885, Dec. 18, 2012.
(Continued)

*Primary Examiner* — Edward Tolan
(74) *Attorney, Agent, or Firm* — Ditthavong & Steiner, P.C.

(57) ABSTRACT

A hot forging press machine includes a fixed lower die, a vertically movable upper die, a punching blade for punching, and a deburring blade. The deburring blade includes a deburring upper blade and a deburring lower blade to perform deburring. The deburring upper blade is fixed to a lower portion of the upper die, and the lower blade is fixed to an upper portion of the lower die. A lower sweeping plate urged upward by a spring is slidably fitted to an outer circumference of the lower blade to perform deburring, and an upper sweeping plate of the upper die presses an entirety of an upper surface of a flange portion of a pressed product to perform the discharging.

2 Claims, 15 Drawing Sheets

(51) Int. Cl.
*B21J 5/02* (2006.01)
*B21K 1/40* (2006.01)

(56) References Cited

U.S. PATENT DOCUMENTS

| | | | | | |
|---|---|---|---|---|---|
| 3,688,549 | A | * | 9/1972 | Toshimi Ohnishi et al. | 72/334 |
| 3,733,873 | A | * | 5/1973 | Ballmer | 72/332 |
| 5,606,887 | A | * | 3/1997 | Spiegelberg et al. | 72/357 |
| 2008/0104843 | A1 | * | 5/2008 | Matsushita | 29/893.33 |

FOREIGN PATENT DOCUMENTS

| | | | | | |
|---|---|---|---|---|---|
| JP | 07-317755 | | 12/1995 | | |
| JP | 08-243678 | | 9/1996 | | |
| JP | 08-276240 | | 10/1996 | | |
| JP | 11-270580 | | 10/1999 | | |
| JP | 2003-266138 | | 9/2003 | | |
| JP | 2008-062276 | | 3/2008 | | |
| JP | 2010-64114 | A * | 3/2010 | | B21J 5/02 |
| JP | 2010-194580 | | 9/2010 | | |

OTHER PUBLICATIONS

Written Opinion for corresponding International Application No. PCT/ JP2012/074885, Dec. 18, 2012.

Japanese Office Action for corresponding JP Application No. 2011-214128, Jun. 25, 2012.

* cited by examiner

HOT FORGING PRESS MACHINE

CROSS-REFERENCE TO RELATED APPLICATIONS

The present application is a continuation application of International Application No. PCT/JP2012/074885, filed Sep. 27, 2012, which claims priority to Japanese Patent Application No. 2011-214128, filed Sep. 29, 2011. The contents of these applications are incorporated herein by reference in their entirety.

BACKGROUND OF THE INVENTION

1. Field of the Invention

The invention relates to a hot forging press machine.

2. Discussion of the Background

Conventionally, as a hot forging press machine used in punching and deburring, one such as described in JP 11-270580 A (FIG. 2(6), Paragraph No. 0019) has been known. It is described that when such a hot forging press machine is used, it is preferable to form flange's outer circumference, a rectangular hole, and a spline hole by punching simultaneously. According to the description, it is considered possible to eliminate relative misalignment in position among the flange's outer circumference, a rectangular hole, and a spline hole and form them by punching in one process.

SUMMARY OF THE INVENTION

According to one aspect of the present invention, a hot forging press machine includes a fixed lower die, a vertically movable upper die, a punching blade for punching, and a deburring blade. The deburring blade includes a deburring upper blade and a deburring lower blade to perform deburring. The hot forging press machine is to manufacture a pressed product by hot forging from an intermediate member having a solid shaft portion and a flange portion projecting in a radially outward direction from the shaft portion, specifically, by performing deburring by setting the intermediate member in the lower die and lowering the deburring upper blade, to open the dies to move the pressed product upward along with the upper die until it is discharged from this upper die, and to simultaneously perform punching and deburring in condition where an entirety of the flange portion of the intermediate member can be sandwiched under pressure by the lower die and the upper die. The punching involves punching of the shaft portion and/or punching of the flange portion. The deburring upper blade is fixed to a lower portion of the upper die, and the lower blade is fixed to an upper portion of the lower die. A lower sweeping plate urged upward by a spring is slidably fitted to an outer circumference of the lower blade to perform deburring, and an upper sweeping plate of the upper die presses an entirety of an upper surface of the flange portion of the pressed product to perform the discharging.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
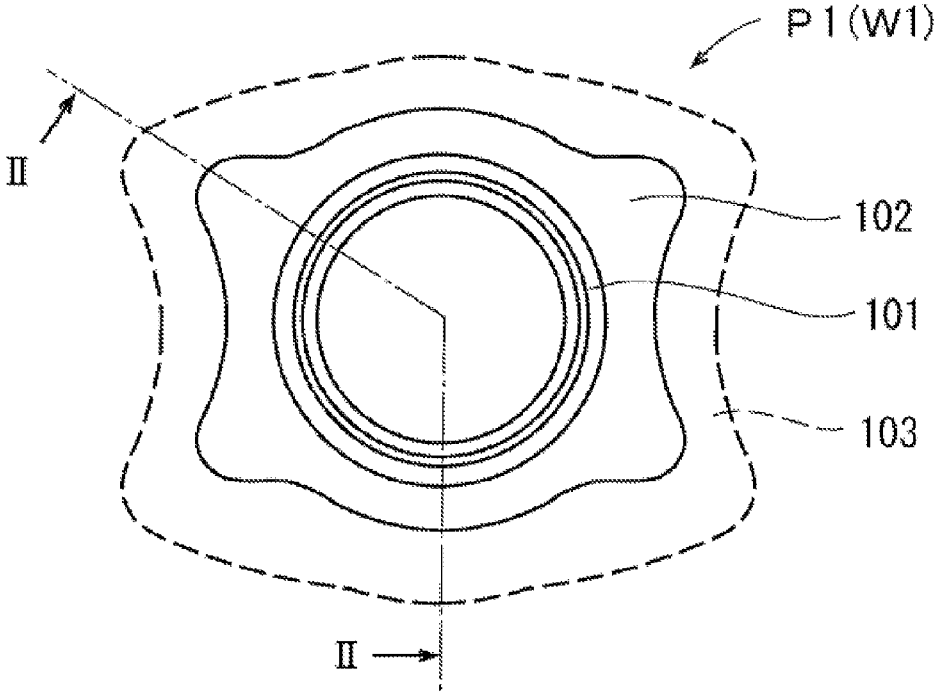
FIG. 1 is a front view of an intermediate member and a pressed product according to a hot forging press machine of a first embodiment.

The embodiments will now be described with reference to the accompanying drawings, wherein like reference numerals designate corresponding or identical elements throughout the various drawings.

First to third embodiments of a hot forging press machine according to the embodiment will be described with reference to the drawings.

Figure 2:
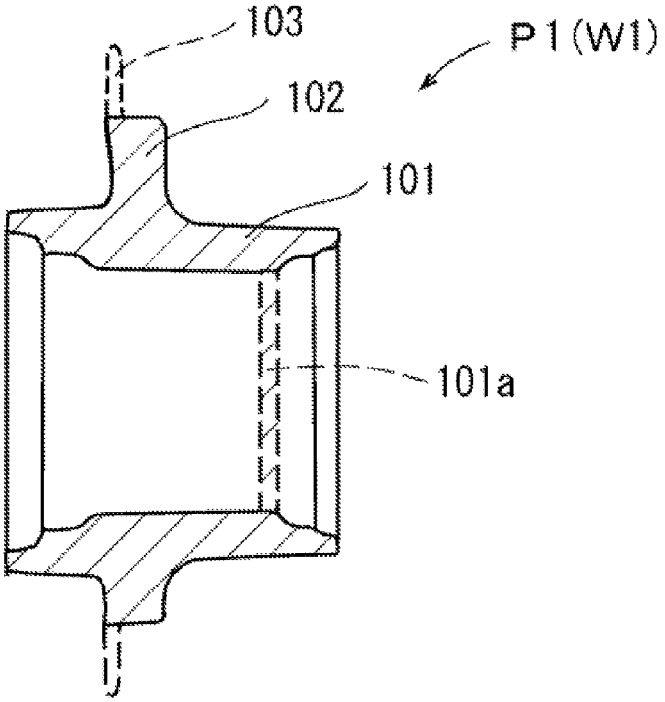
FIG. 2 is a cross-sectional view taken along arrow line II-II of FIG. 1 according to the hot forging press machine of the first embodiment.

First, a description will be given of the mechanical configuration of a hot forging press machine of a first embodiment. FIGS. 1 and 2 are a front view and a cross sectional view of an intermediate member W1 before being pressed and a pressed product P1 after being pressed by the hot forging press machine of the first embodiment. As shown in FIGS. 1 and 2, the intermediate member W1 includes a solid shaft portion 101 having a bottom portion 101*a*, a flange portion 102 projecting outward radially from the shaft portion 101, and a burr 103. The bottom portion 101*a* is punched and the burr 103 is deburred by the hot forging press machine of the first embodiment, to manufacture the pressed product P1.

Figure 3:
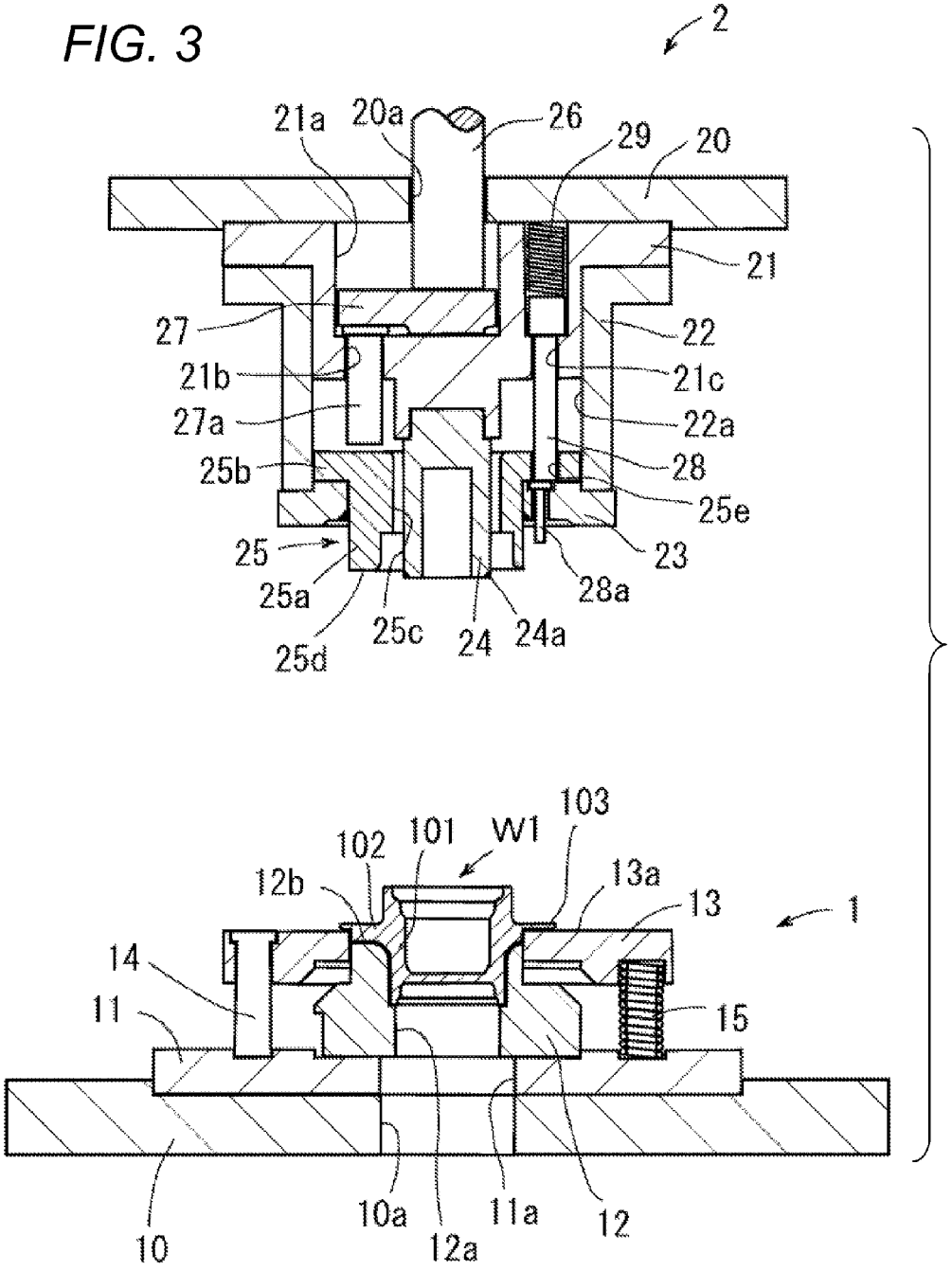
FIG. 3 is a cross-sectional view before dies are closed according to the hot forging press machine of the first embodiment.

FIG. 3 is a cross-sectional view of the hot forging press machine before dies are closed. The hot forging press machine includes a fixed lower die 1 and an upper die 2 vertically movable with respect to the lower die 1. The lower die 1 has a lower base plate 10, a lower plate 11, a lower blade 12, a lower sweeping plate 13, a guide pin 14, and a spring 15. At the midsection of the lower base plate 10 constituting the body of the lower die 1, a through hole 10*a* is formed through which the bottom portion 101*a* removed from the shaft portion 101 of the intermediate member W1 is permitted to fall. To the upper portion of the lower base plate 10, the lower plate 11 is fixed in which a through hole 11*a* is formed to play the same role as the through hole 10*a*, which the through hole 11*a* communicates with the through hole 10*a*.

To the upper portion of the lower plate 11, the lower blade 12 is fixed. The lower blade 12 is configured to place the intermediate member W1 thereon and also serves to remove the burr 103 from underneath. On the upper surface of the lower blade 12, a loading surface 12*b* is formed. On the loading surface 12*b*, an entirety of the flange portion 102 of the intermediate member W1 is placed. When the dies are closed, the entirety of the flange portion 102 is sandwiched under pressure by the loading surface 12*b* and a pressing surface 25*d* of an upper sweeping plate 25 to be described later. In the lower blade 12, a through hole 12*a* is also formed, which communicates with the through holes 10*a* and 11*a*.

At the upper portion of the lower blade 12, the lower sweeping plate 13 is slidably fitted to the outer circumference of the lower blade 12. The lower sweeping plate 13 is guided by the guide pin 14 to be vertically slidable and urged upward by the spring 15. On the upper surface of the lower sweeping plate 13, a loading surface 13*a* is formed. On the loading surface 13*a*, an entirety of the burr 103 of the intermediate member W1 is placed.

The upper die 2 has an upper base plate 20, an upper blade holder 21, a deburring upper blade holder 22, a deburring upper blade 23, a center punching blade 24, the upper sweeping plate 25, a press-down rod 26, a stripper plate 27, a stripper pin 27*a*, first and second deburring pins 28 and 28*a*, and a spring 29. At the midsection of the upper base plate 20 constituting the body of the upper die 2, a through hole 20*a* is formed through which the later-described press-down rod 26 is vertically slidable.

To the lower portion of the upper base plate 20, the substantially column-shaped upper blade holder 21 is fixed in which a concave portion 21*a* with an opening opened upward is formed. The substantially cylindrical deburring upper blade holder 22 having an inner circumferential surface 22*a* is fixed to the outer circumference of the upper blade holder 21, and the center punching blade 24 is fixed to the lower portion of the upper blade holder 21. Further, in the upper blade holder 21, a through hole 21*b* is formed to permit the later-described stripper pin 27*a* vertically slidable therethrough and also a through hole 21*c* is formed to permit the later-described first deburring pin 28 vertically slidable therethrough.

To the lower portion of the deburring upper blade holder 22, the deburring upper blade 23 is fixed. The deburring upper blade 23 is used to remove the burr 103 from the flange portion 102 of the intermediate member W1, performing so-called deburring operations. On the lower-end outer circumference of the center punching blade 24, a blade 24*a* is formed. The center punching blade 24 is used to punch the bottom portion 101*a* in the shaft portion 101 of the intermediate member W1, performing so-called punching operations. Those upper base plate 20, upper blade holder 21, deburring upper blade holder 22, deburring upper blade 23, and center punching blade 24 are integrally configured to be vertically movable without changing their relative positions.

Figure 4:
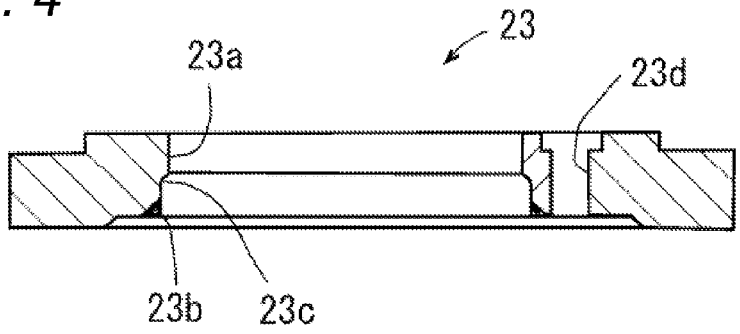
FIG. 4 is an enlarged cross-sectional view of a deburring upper blade according to the hot forging press machine of the first embodiment.

As shown in FIG. 4, the deburring upper blade 23 has a cylindrical shape and has a blade 23*b* formed at the lower end and the inner circumference of the inner circumferential portion 23*a*. Generally, no step is provided on the inner circumferential portion 23*a*. However, only in a case where it is desired to forcedly add a small round shape (of up to about R3) to the flange portion 102 of the pressed product P1, it is possible to substitute with the deburring upper blade 23 with a round shape 23*c* in the vicinity of the blade 23*b*. In the deburring upper blade 23, a through hole 23*d* is formed through. Although FIG. 4 shows an example where the round shape 23*c* is formed in the vicinity of the blade 23*b*, the round shape 23*c* may be replaced with a chamfering shape (of up to about C3).

As shown in FIG. 3, the upper sweeping plate 25 is provided so as to be vertically slidable over the inner circumferential surface 22*a* and the inner circumferential portion 23*a*. The upper sweeping plate 25 has a flange 25*b* projecting outward radially from the upper portion of a shaft 25*a* having an inner circumferential portion 25*c*, the pressing surface 25*d* formed on the lower end surface of the shaft 25*a*, and a through hole 25*e* formed through the flange 25*b*. Further, the upper sweeping plate 25 is pressed downward by the stripper pin 27*a* arranged in the through hole 21*b* of the upper blade holder 21 so as to be vertically slidable in this hole. This stripper pin 27*a* is pressed downward by the stripper plate 27 arranged in the concave portion 21*a* so as to be vertically slidable in this concave portion. Further, the stripper plate 27 is pressed downward by the press-down rod 26 provided to be vertically slidable through the through hole 20*a*. Accordingly, when the press-down rod 26 is pressed down, the upper sweeping plate 25 is pressed down. The upper sweeping plate 25 serves to sandwich the entirety of the flange portion 102 under pressure when punching the bottom portion 101*a* and removing the burr 103 of the intermediate member W1 by closing the dies (only when the flange portion 102 has warped. It is to be noted that the entirety of the flange portion 102 may be sandwiched under pressure no matter whether the flange portion 102 has warped or not.) and also serves to press the pressed product P1 downward when the pressed product P1 is discharged.

Further, a spring 29 is arranged in the through hole 21*c* of the upper blade holder 21, and the first deburring pin 28 is arranged in the through holes 21*c* and 25*e* so as to be vertically slidable through them. In the through hole 23*d*, the second deburring pin 28*a* is arranged so as to be vertically slidable through it. Consequently, the second deburring pin 28*a* is pressed downward via the first deburring pin 28 by urging force from the spring 29 arranged in the through hole 21*c* between the upper base plate 20 and the first deburring pin 28. When the dies are opened, the second deburring pin 28*a* serves to cut off the burr 103 from the pressed product P1 and to place the burr 103 on the loading surface 13*a*.

The following will describe a method of manufacturing the pressed product P1 from the intermediate member W1 by using the hot forging press machine having the mechanical configuration described above. First, as shown in FIG. 3, the intermediate member W1 is set to the hot forging press machine before the dies are closed. At this time, an entirety of the surface of the flange portion 102 of the intermediate member W1 should be securely abut against the loading surface 12*b*.

Figure 5:
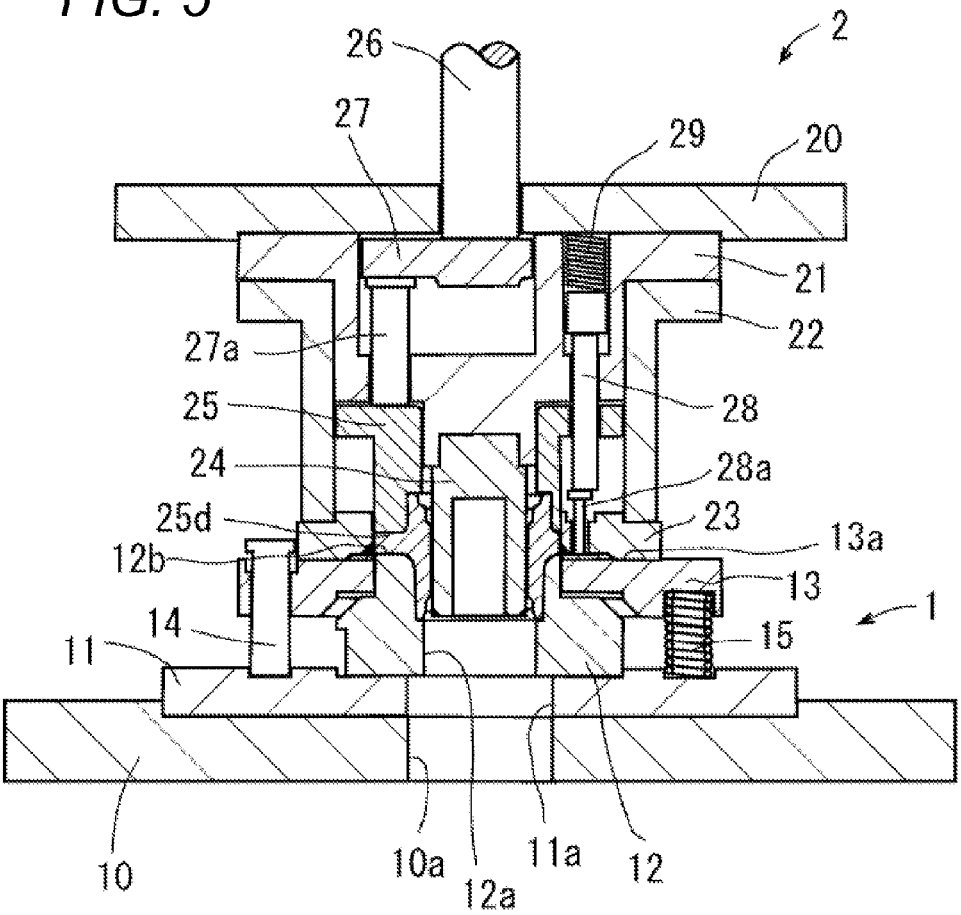
FIG. 5 is a cross-sectional view when the dies are closed according to the hot forging press machine of the first embodiment.

When the upper die 2 is moved downward to close the dies, as shown in FIG. 5, the bottom portion 101*a* of the shaft portion 101 is punched by the center punching blade 24 (punching) and the burr 103 is removed from the flange portion 102 by the deburring upper blade 23 (deburring). At this time, when the flange portion 102 has warped, the entirety of the flange portion 102 is sandwiched under pressure by the loading surface 12*b* and the pressing surface 25*d*. Then, the punched bottom portion 101*a* is permitted to fall through the through holes 12*a*, 11*a*, and 10*a*. The burr 103 is placed under pressure on the loading surface 13*a* by the second deburring pin 28*a*.

Figure 6:
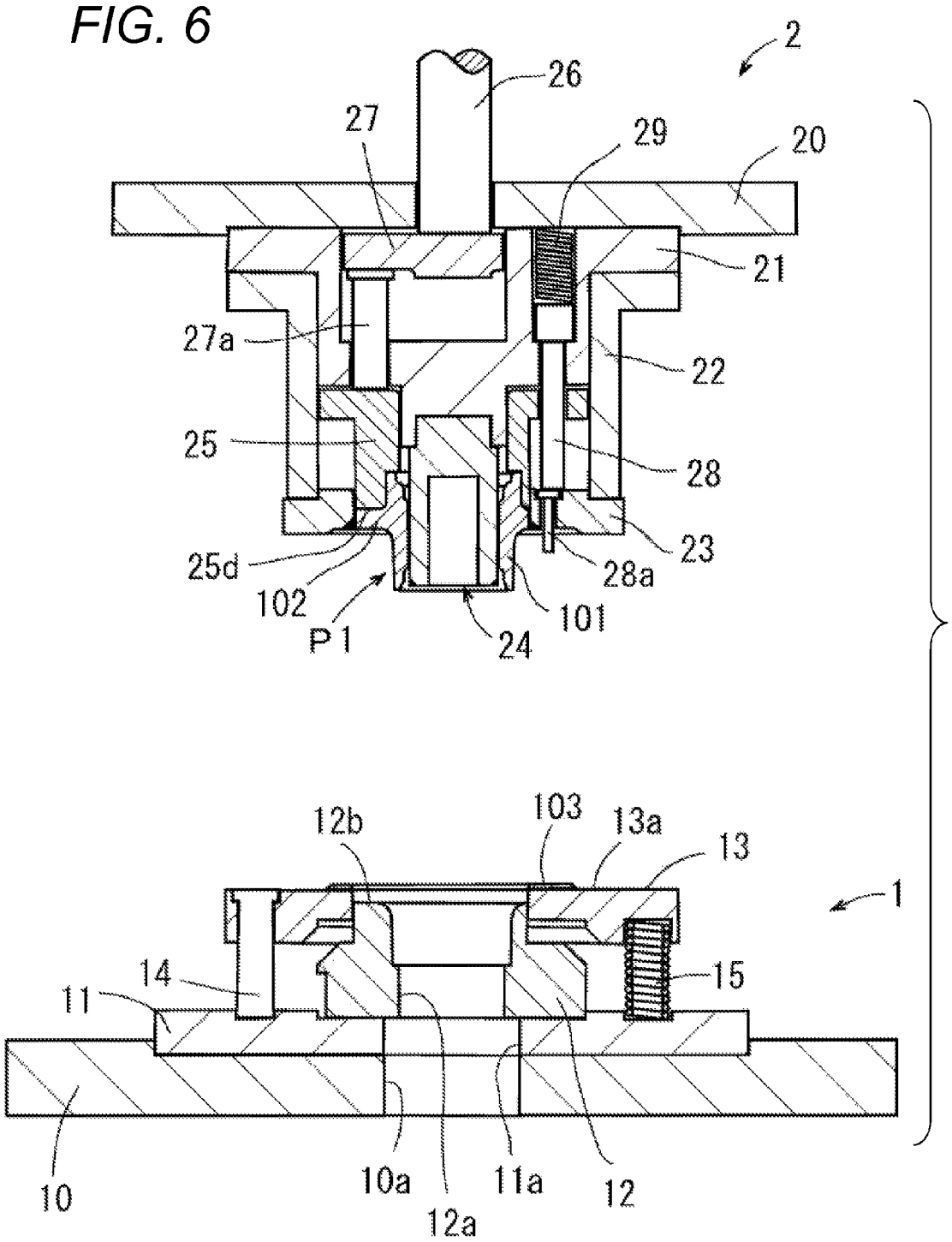
FIG. 6 is a cross-sectional view when the dies are opened according to the hot forging press machine of the first embodiment.
Figure 7:
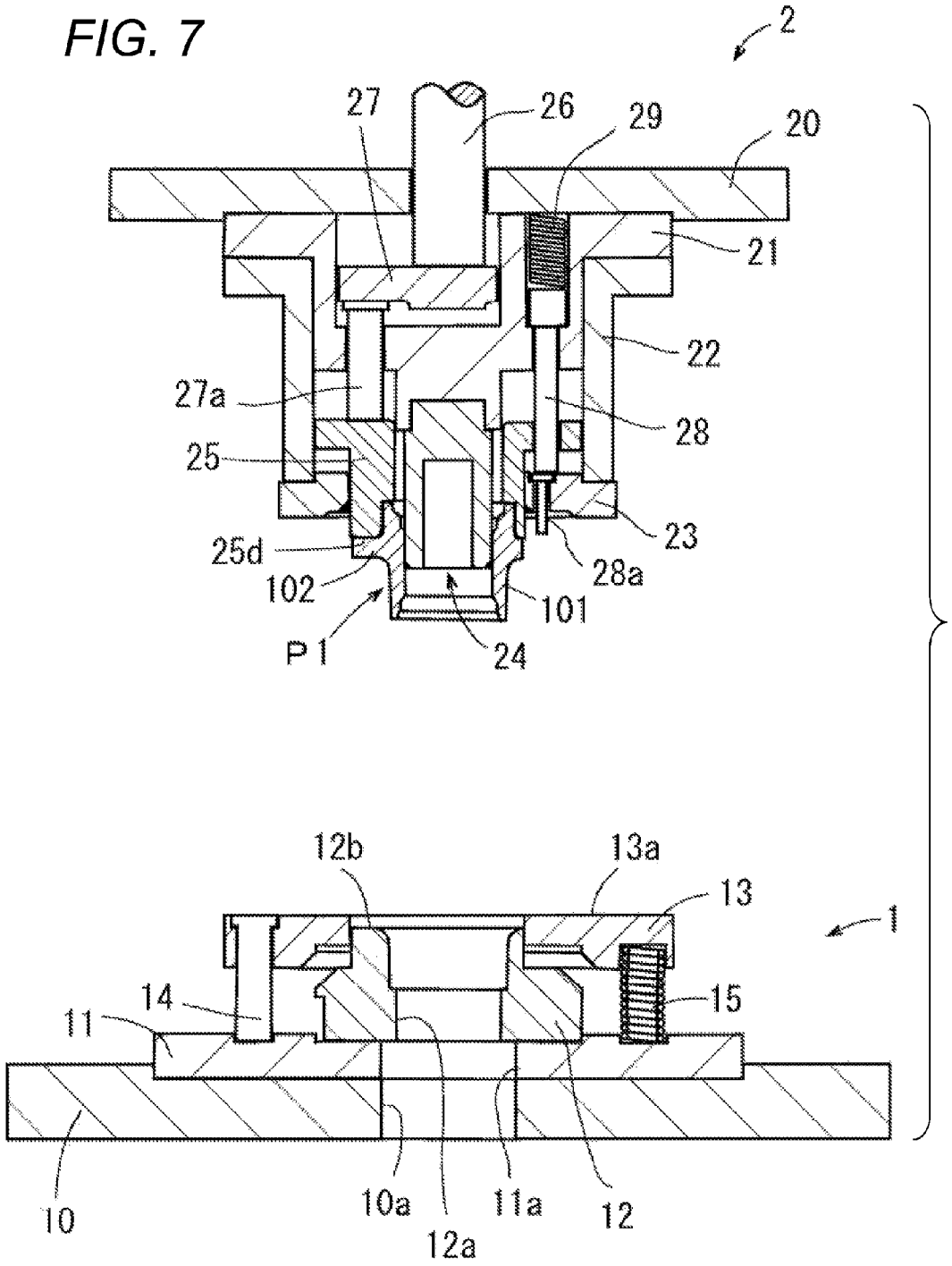
FIG. 7 is a cross-sectional view when the pressed product is discharged according to the hot forging press machine of the first embodiment.

When the upper die 2 is moved upward to open the dies, as shown in FIG. 6, the pressed product P1 is moved upward along with the upper die 2. At the early stage of a process of die opening, the burr 103 is still pressed onto the loading surface 13*a* by the second deburring pin 28*a* and, therefore, is securely cut off from the pressed product P1 and placed on the loading surface 13*a*. When the dies are opened further, the lower sweeping plate 13 is urged to press the burr 103 upward. Then, as shown in FIG. 7, the burr 103 is blown off from the loading surface 13*a* by air.

Further, when the press-down rod 26 is pressed downward, the upper sweeping plate 25 is pressed downward. Consequently, the pressed product P1 is pressed downward and discharged from the upper die 2. At this time, the entirety of the flange portion 102 is pressed downward by the pressing surface 25*d*.

In the hot forging press machine of the first embodiment, since the intermediate member W1 is set to the lower blade 12 of the lower die 1 and then the deburring upper blade 23 is lowered from above to perform deburring, the flange portion 102 does not easily have burrs on the upper surface thereof. This will eliminate the need of deburring the pressed product P1.

That is, since burrs are removed from above, burrs are not likely to occur on an upper end portion of the deburred surface of the pressed product. Therefore, this will greatly mitigate the finishing of the upper end portion in the post-process, and improve productivity. In the case of conventional hot forging press machines, the deburring blade is fixed to the lower die and the intermediate member W1 is lowered from above to perform deburring, so that the flange portion 102 have burrs on the upper surface thereof.

In the present hot forging press machine, since punching and deburring are performed simultaneously, punching can be carried out in one process. Moreover, in the present hot forging press machine, when there is a possibility that the flange portion 102 of the pressed product P1 may warp, punching and deburring are performed by sandwiching the entirety of the flange portion 102 of the intermediate member W1 under pressure by the loading surface 12*b* and the pressing surface 25*d*. Therefore, the flange portion 102 of the pressed product P1 does not easily warp. Consequently, according to the hot forging press machine of the first embodiment, it is possible to precisely perform punching and deburring simultaneously. Since the flange portion 102 of the pressed product P1 does not easily warp, it need not have a large machining allowance at the time of pressing nor be flattened forcedly after pressing.

In the present hot forging press machine, generally, no step is provided on the inner circumferential portion 23*a*. However, only in a case where it is desired to forcedly add a small round shape (of up to about R3) to the flange portion 102 of the pressed product P1, it is possible to substitute with the deburring upper blade 23 with a round shape 23*c* in the vicinity of the blade 23*b*. In this case, the pressed product P1 is forcedly provided with the small round shape. Therefore, the flange portion 102 of the pressed product P1 need not be chamfered.

Moreover, in the present hot forging press machine, the pressed product P1 is discharged from the upper die 2 by pressing the entirety of the upper surface of the flange portion 102 of the pressed product P1 with the upper sweeping plate 25. Therefore, the flange portion 102 does not easily warp.

Figure 8:
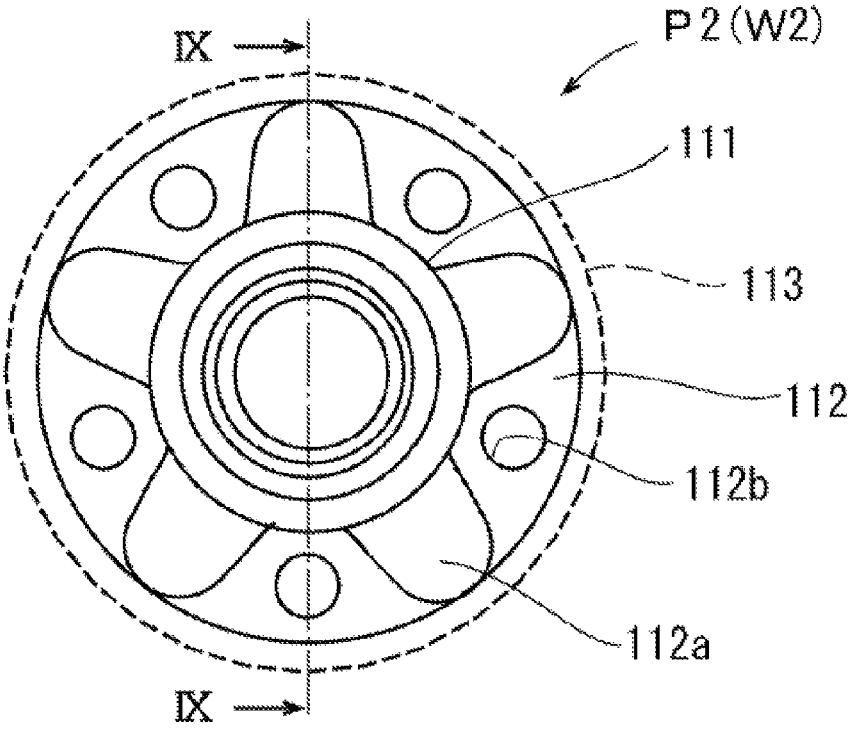
FIG. 8 is a front view of an intermediate member and a pressed product according to a hot forging press machine of a second embodiment.
Figure 9:
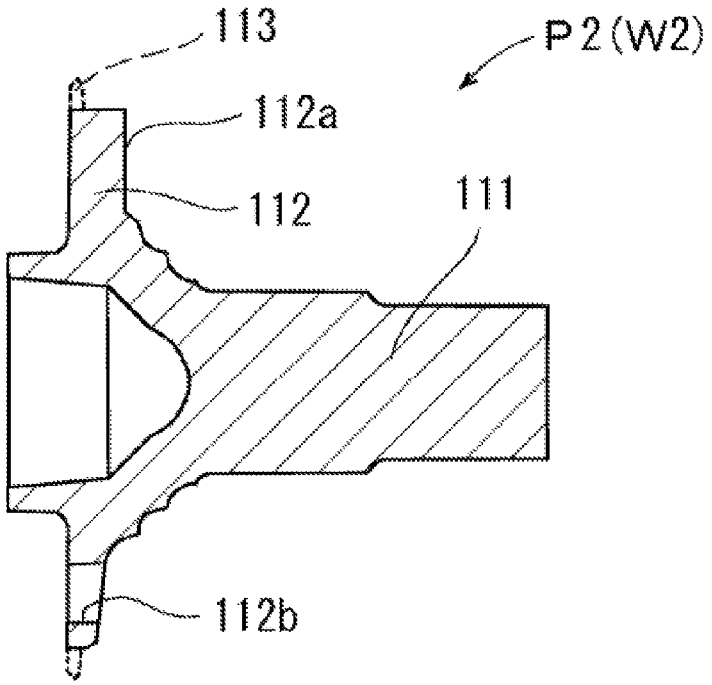
FIG. 9 is a cross-sectional view taken along arrow line IX-IX of FIG. 8 according to the hot forging press machine of the second embodiment.

Next, a description will be given of the mechanical configuration of a hot forging press machine of a second embodiment. FIGS. 8 and 9 are a front view and a cross sectional view of an intermediate member W2 before being pressed and a pressed product P2 after being pressed by the hot forging press machine of the second embodiment. As shown in FIGS. 8 and 9, the intermediate member W2 includes a solid shaft portion 111, a flange portion 112 projecting outward radially from the shaft portion 111, and a burr 113. On the flange portion 112, a pattern 112*a* is provided convexly. The flange hole 112*b* is punched and the burr 113 is removed by the hot forging press machine of the second embodiment, to manufacture the pressed product P2.

Figure 10:
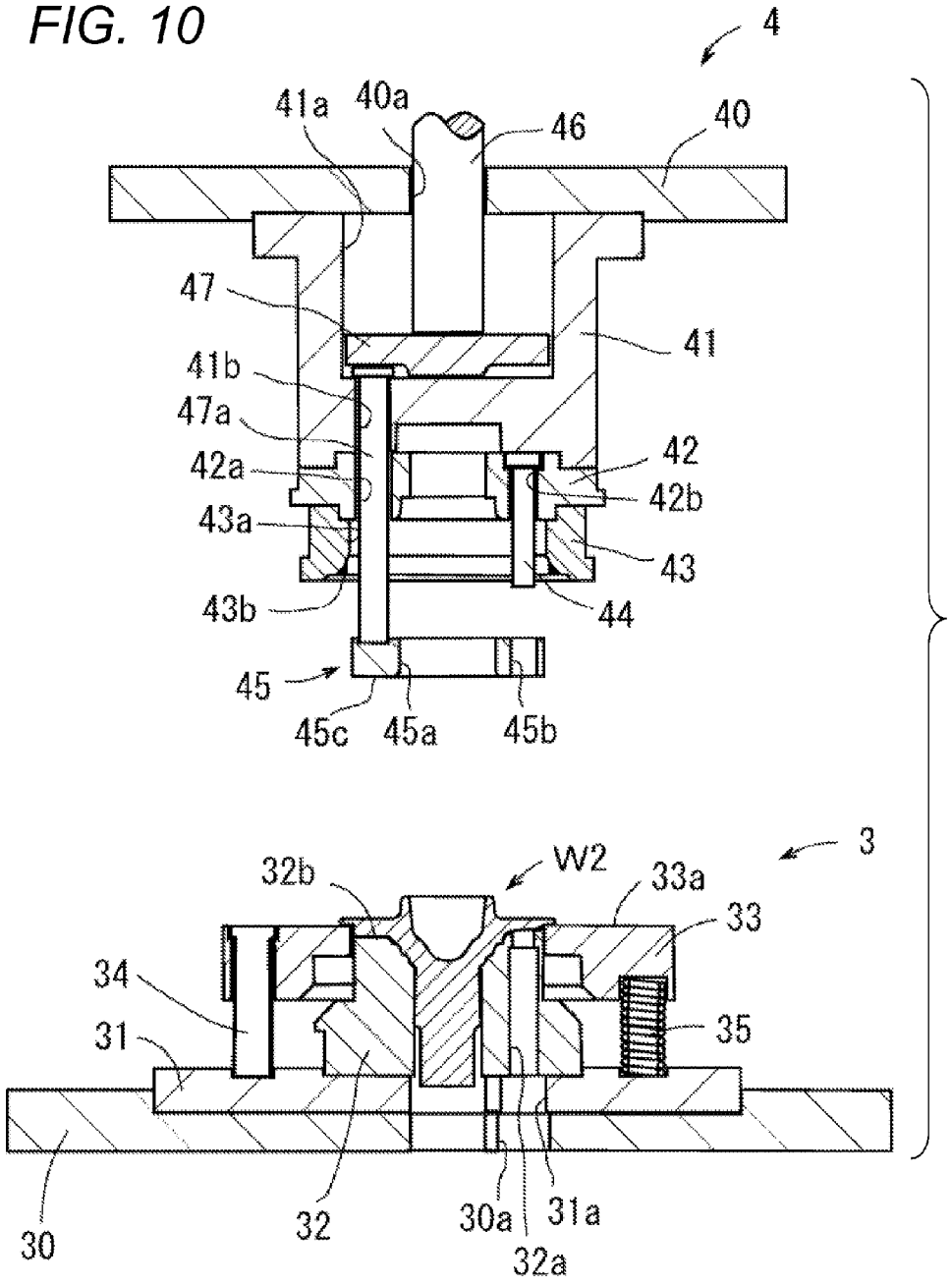
FIG. 10 is a cross-sectional view before the dies are closed according to the hot forging press machine of the second embodiment.

FIG. 10 is a cross-sectional view of the hot forging press machine before dies are closed. The hot forging press machine includes a fixed lower die 3 and an upper die 4 vertically movable with respect to the lower die 3. The lower die 3 has a lower base plate 30, a lower plate 31, a lower blade 32, a lower sweeping plate 33, a guide pin 34, and a spring 35. In the lower base plate 30 constituting the body of the lower die 3, a through hole 30*a* is formed to permit pieces of a flange hole 112*b* punched in the flange portion 112 of the intermediate member W2 to fall. To the upper portion of the lower base plate 30, the lower plate 31 is fixed, in which a through hole 31*a* is formed which plays the same role as the through hole 30*a*. In addition, the through holes 30*a* and 31*a* communicate with each other.

To the upper portion of the lower plate 31, the lower blade 32 is fixed. The lower blade 32 serves to place the intermediate member W2 thereon and also remove the bur 113 from underneath. On the upper surface of the lower blade 32, a loading surface 32*b* is formed to place an entirety of the flange portion 112 of the intermediate member W2 thereon. On the loading surface 32*b*, the same shape as the pattern 112*a* is provided concavely. When the dies are closed, the entirety of the flange portion 112 is sandwiched under pressure by the loading surface 32*b* and a pressing surface 45*c* of an upper sweeping plate 45 to be described later. In the lower blade 32 also, a through hole 32*a* is formed which communicates with the through holes 30*a* and 31*a*.

To the upper portion of the lower blade 32, the lower sweeping plate 33 is slidably fitted on an outer circumference of the lower blade 32. The lower sweeping plate 33 is guided by the guide pin 34 to be vertically slidable and urged upward by the spring 35. On the upper surface of the lower sweeping plate 33, a loading surface 33*a* is formed to place an entirety of the burr 113 of the intermediate member W2 thereon.

The upper die 4 has an upper base plate 40, an upper blade holder 41, a punching blade holder 42, a deburring upper blade 43, a flange punching blade 44, an upper sweeping plate 45, a press-down rod 46, a stripper plate 47, and a stripper pin 47*a*. In the midsection of the upper base plate 40 constituting the body of the upper die 4, a through hole 40*a* is formed through which the later-described press-down rod 46 is vertically slidable.

Further, to the lower portion of the upper base plate 40, the substantially column-shaped upper blade holder 41 is fixed in which a concave portion 41*a* having an opening opened upward is formed. In the upper blade holder 41, a through hole 41*b* is formed through which the later-described stripper pin 47*a* is vertically slidable. To the lower portion of the upper blade holder 41, the punching blade holder 42 is fixed. The punching blade holder 42 has a through hole 42*a* through which the stripper pin 47*a* is vertically slidable and a through hole 42*b* in which the later-described punching blade 44 is housed.

To the lower portion of the punching blade holder 42, the deburring upper blade 43 is fixed. The deburring upper blade 43 is used to remove the burr 113 from the flange portion 112 of the intermediate member W2, performing so-called deburring. The deburring upper blade 43 has a cylindrical shape and has a blade 43*b* at lower end and the inner circumference of an inner circumferential portion 43*a*. Generally, no step is provided on the inner circumferential portion 43*a*. However, only in a case where it is desired to forcedly add a small round shape (of up to about R3) to the flange portion 112 of the pressed product P2, it is possible to substitute with the deburring upper blade 43 with a round shape (see the round shape 23*c* in FIG. 4 according to the first embodiment) in the vicinity of the blade 43*b*. This round shape may be replaced with a chamfering shape (of up to about C3).

Further, in the through hole 42*b* of the punching blade holder 42, the flange punching blade 44 is housed not to be vertically movable through the inner circumferential portion 43*a* of the deburring upper blade 43. The flange punching blade 44 is used to punch the flange hole 112*b* in the flange portion 112 of the intermediate member W2, performing so-called punching. Those upper base plate 40, upper blade holder 41, punching blade holder 42, deburring upper blade 43, and flange punching blade 44 are integrally configured to be vertically movable without changing their relative positions.

Below the deburring upper blade 43, the upper sweeping plate 45 is provided so as to be vertically movable. The upper sweeping plate 45 has a substantially cylindrical shape and has an inner circumferential surface 45*a* where part of the shaft portion 111 of the intermediate member W2 is housed, a through hole 45*b* through which the punching blade 44 passes vertically, and a pressing surface 45*c* formed on the lower end surface thereof. The upper sweeping plate 45 is fixed to the lower end of the stripper pin 47*a* arranged to be vertically slidable through the through hole 41*b* of the upper blade holder 41 and the through hole 42*a* of the punching blade holder 42. This stripper pin 47*a* is pressed downward by the stripper plate 47 arranged to be vertically slidable in the concave portion 41*a*. Further, the stripper plate 47 is pressed downward by the press-down rod 46 vertically slidable through the through hole 40*a*. Consequently, as the press-down rod 46 is pressed downward, the upper sweeping plate 45 is pressed downward. The upper sweeping plate 45 serves to sandwich the entirety of the flange portion 112 under pressure when punching the flange hole 112*b* in and removing the burr 113 of the flange portion 112 of the intermediate member W2 by closing the dies (only when the flange portion 112 has warped. It is to be noted that the entirety of the flange portion 112 may be sandwiched under pressure no matter whether the flange portion 112 has warped or not.) and also serves to press the pressed product P2 downward when discharging the pressed product P2.

The following will describe a method of manufacturing the pressed product P2 from the intermediate member W2 by using the hot forging press machine having the mechanical configuration described above. First, as shown in FIG. 10, the intermediate member W2 is set to the hot forging press machine before the dies are closed. At this time, an entirety of the surface of the flange portion 112 of the intermediate member W2 should securely abut against the loading surface 32*b*. The pattern 112*a* is provided convexly on the flange portion 112 and the same shape as the pattern 112*a* is provided concavely on the loading surface 32*b*, so that it is possible to easily make the entirety of the surface of the flange portion 112 of the intermediate member W2 abut against the loading surface 32*b*.

Figure 11:
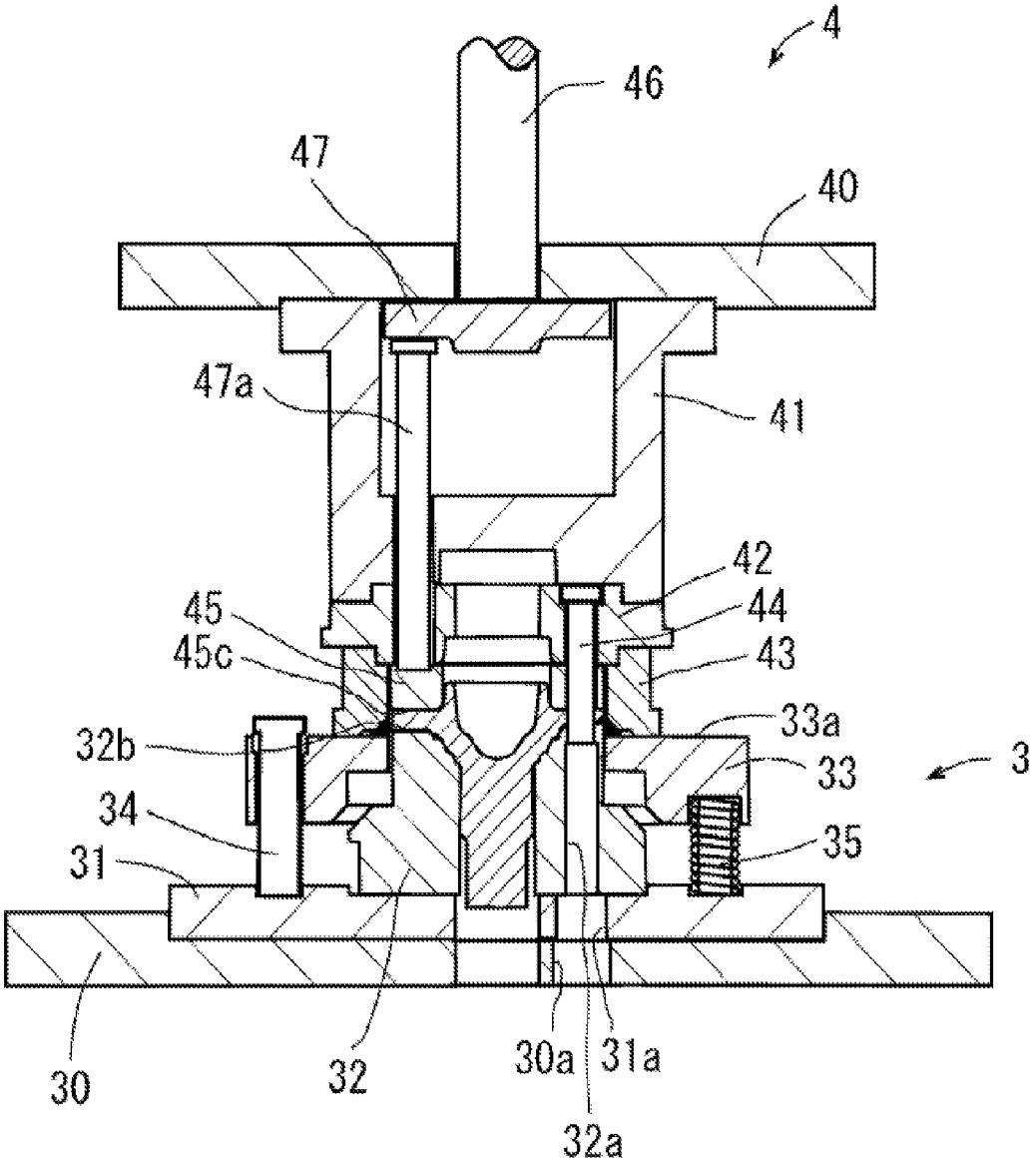
FIG. 11 is a cross-sectional view when the dies are closed according to the hot forging press machine of the second embodiment.

When the upper die 4 is moved downward to close the dies, as shown in FIG. 11, the flange hole 112*b* is punched in the flange portion 112 by the flange punching blade 44 (punching) and the burr 113 is deburred from the flange portion 112 by the deburring upper blade 43 (deburring). At this time, when the flange portion 112 has warped, the entirety of the flange portion 112 is sandwiched under pressure by the loading surface 32*b* and the pressing surface 45*c*. Then, pieces of the punched flange hole 112*b* are permitted to fall through the through holes 32*a*, 31*a*, and 30*a*. Further, the burr 113 is placed on the loading surface 33*a* under pressure.

Figure 12:
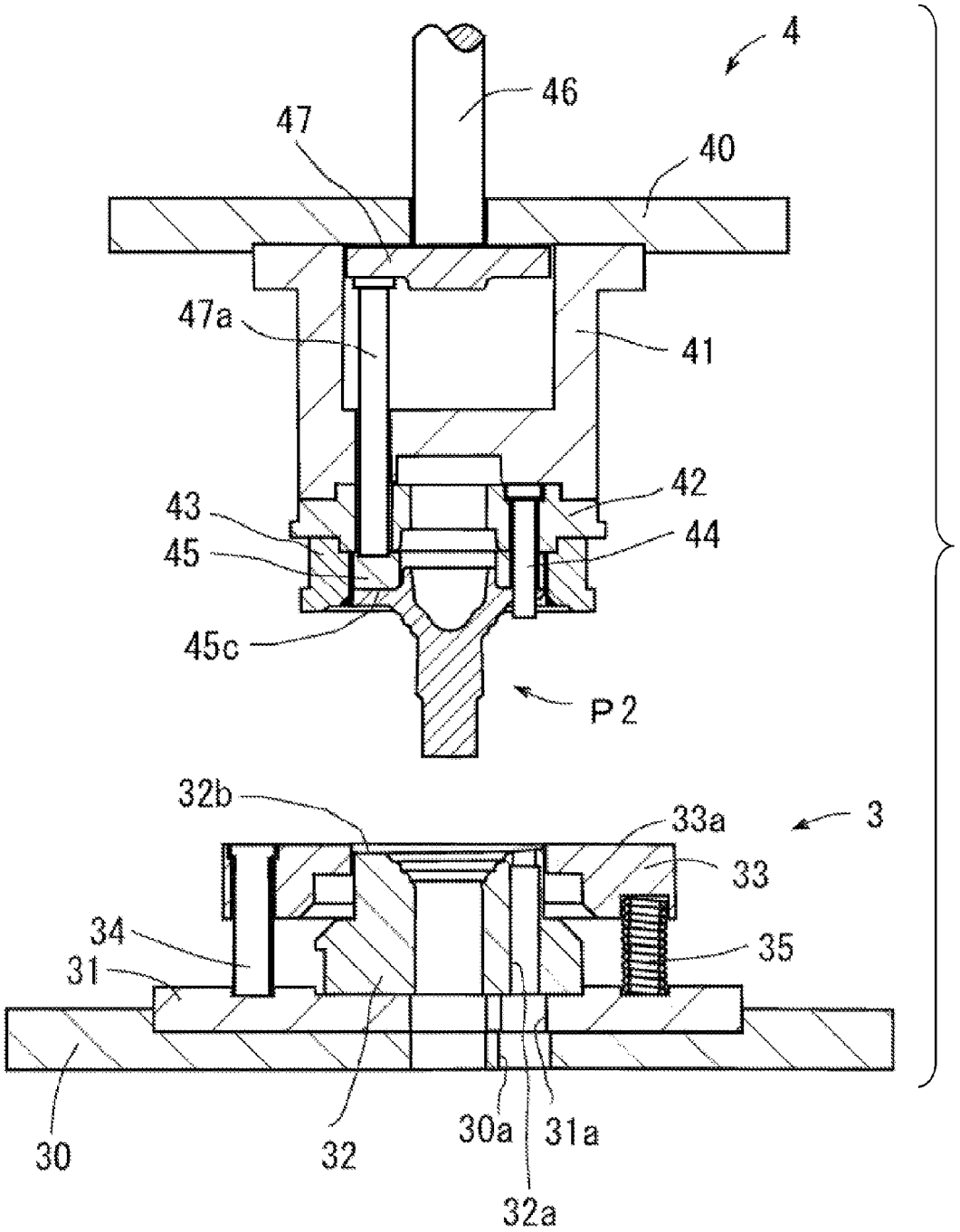
FIG. 12 is a cross-sectional view when the dies are opened according to the hot forging press machine of the second embodiment.

When the upper die 4 is moved upward to open the dies, as shown in FIG. 12, the pressed product P2 moves upward along with the upper die 4. Then, the burr 113 is urged to be pressed up by the lower sweeping plate 33 and blown off from the loading surface 33*a* by air.

Figure 13:
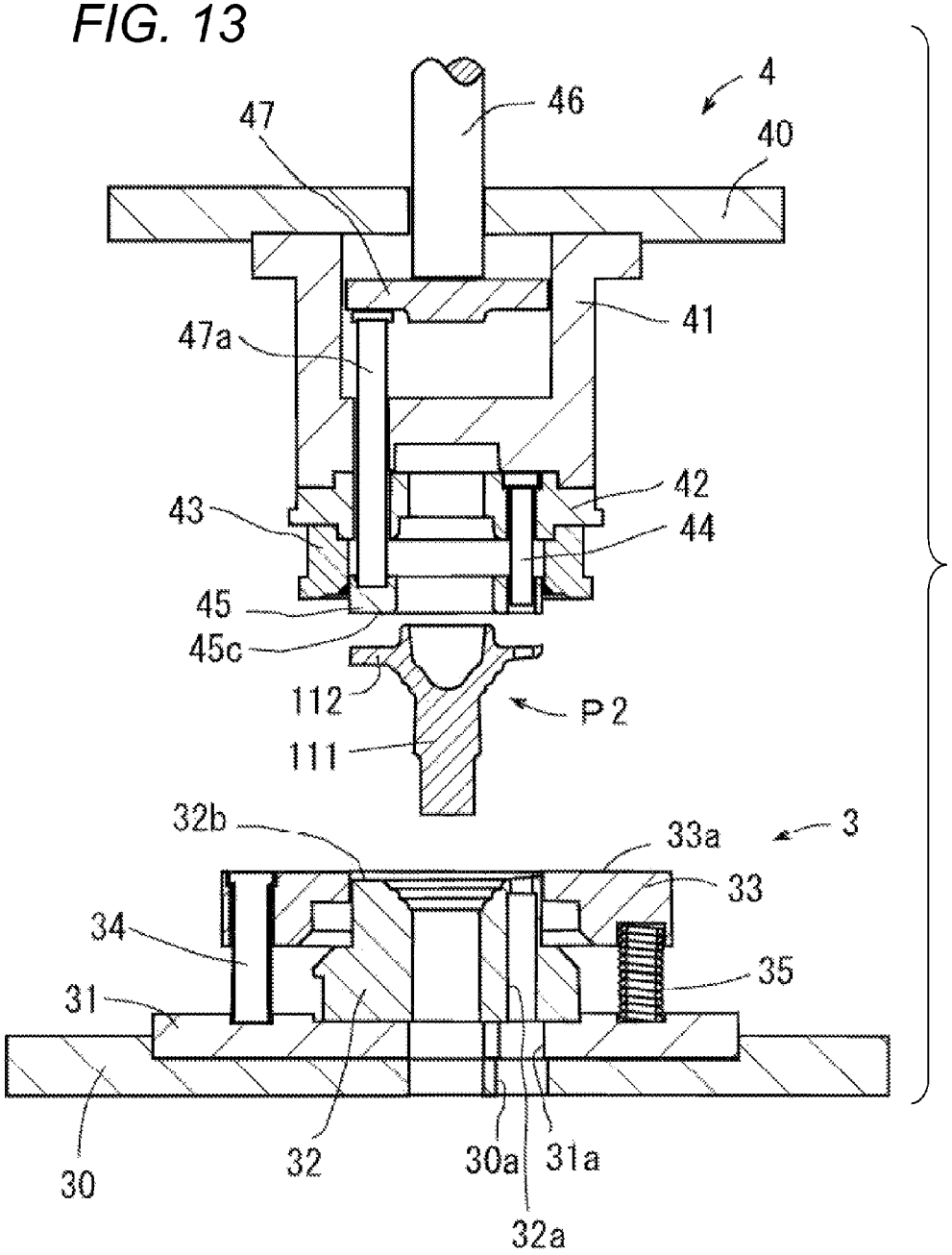
FIG. 13 is a cross-sectional view when the pressed product is discharged according to the hot forging press machine of the second embodiment.

Further, as shown in FIG. 13, the press-down rod 46 is pressed downward to thereby press the upper sweeping plate 45 downward. Consequently, the pressed product P2 is pressed downward to be discharged from the upper die 4. At this time, the entirety of the flange portion 112 is pressed downward by the pressing surface 45*c*.

Like the first embodiment, in the hot forging press machine of the second embodiment, since the intermediate member W2 is set to the lower blade 32 of the lower die 3 and then the deburring upper blade 43 is lowered from above to perform deburring, the flange portion 112 does not easily have burrs on the upper surface thereof. This will eliminate the need of deburring the pressed product P2. That is, since burrs are removed from above, burrs are not likely to occur at an upper end portion of the deburred surface of the pressed product. Therefore, this will greatly mitigate the finishing of the upper end portion in the post-process, and improve productivity. In the case of conventional hot forging press machines, the deburring blade is fixed to the lower die and the intermediate member W2 is lowered from above to perform deburring, so that the flange portion 112 have burrs on the upper surface thereof.

In the present hot forging press machine, since punching and deburring are performed simultaneously, punching can be carried out in one process. Moreover, in the present hot forging press machine, when there is a possibility that the flange portion 112 of the pressed product P2 may warp, the entirety of its flange portion 112 is sandwiched under pressure by the loading surface 32*b* and the pressing surface 45*c* to perform punching and deburring. Therefore, the flange portion 112 of the pressed product P2 does not easily warp. Consequently, according to the hot forging press machine of the second embodiment, it is possible to precisely perform punching and deburring simultaneously. Like the first embodiment, since the flange portion 112 of the pressed product P2 does not easily warp, it need not have a large machining allowance at the time of pressing nor be flattened forcedly after pressing.

In the present hot forging press machine, generally, no step is provided on the inner circumferential portion 43*a*. However, only in a case where it is desired to forcedly add a small round shape (of up to about R3) to the flange portion 112 of the pressed product P2, it is possible to substitute with the deburring upper blade 43 with a round shape (see the round shape 23*c* in FIG. 4 according to the first embodiment) in the vicinity of the blade 43*b*. In this case, the pressed product P2 is forcedly provided with the small round shape. Therefore, the flange portion 112 of the pressed product P2 need not be chamfered.

Moreover, in the present hot forging press machine, the pressed product P2 is discharged from the upper die 4 by pressing the entirety of the upper surface of the flange portion 112 of the pressed product P2 with the upper sweeping plate 45. Therefore, the flange portion 112 does not easily warp.

Figure 14:
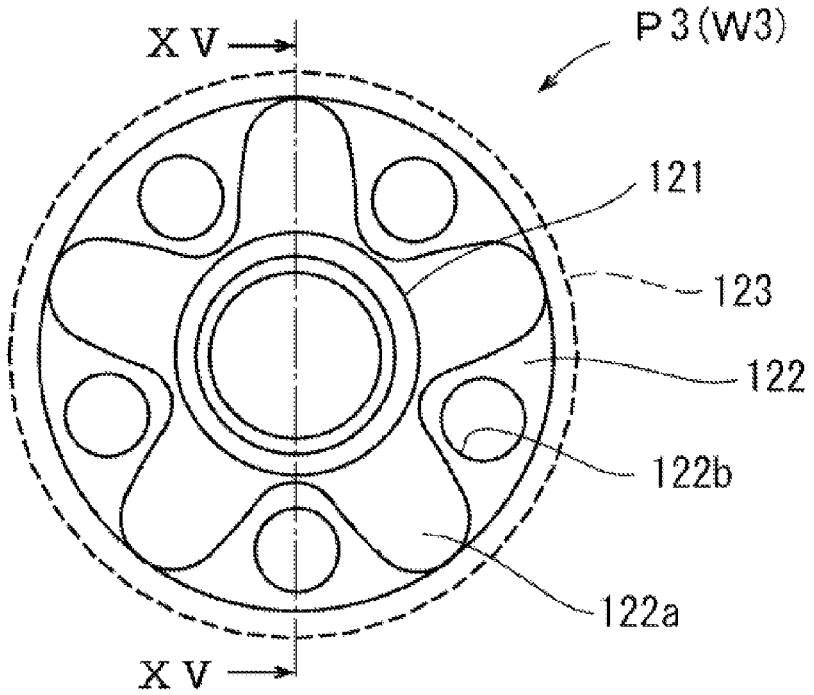
FIG. 14 is a front view of an intermediate member and a pressed product according to a hot forging press machine of a third embodiment.
Figure 15:
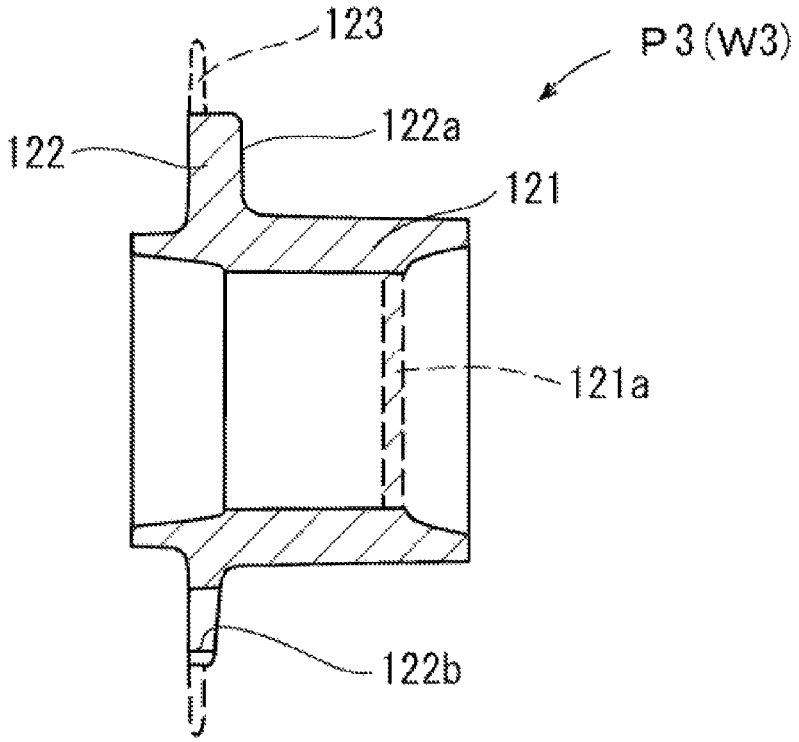
FIG. 15 is a cross-sectional view taken along arrow line XV-XV of FIG. 14 according to the hot forging press machine of the third embodiment.

Next, a description will be given of the mechanical configuration of a hot forging press machine of a third embodiment. FIGS. 14 and 15 are a front view and a cross-sectional view of an intermediate member W3 before being pressed and a pressed product P3 after being pressed by the hot forging press machine of the third embodiment, respectively. As shown in FIGS. 14 and 15, the intermediate member W3 includes a solid shaft portion 121 having a bottom portion 121*a*, a flange portion 122 projecting outward radially from the shaft portion 121, and a burr 123. On the flange portion 122, a pattern 122*a* is provided convexly. The bottom portion 121*a* is punched, a flange hole 122*b* is punched, and the burr 123 is removed by the hot forging press machine of the third embodiment, to manufacture the pressed product P3.

Figure 16:
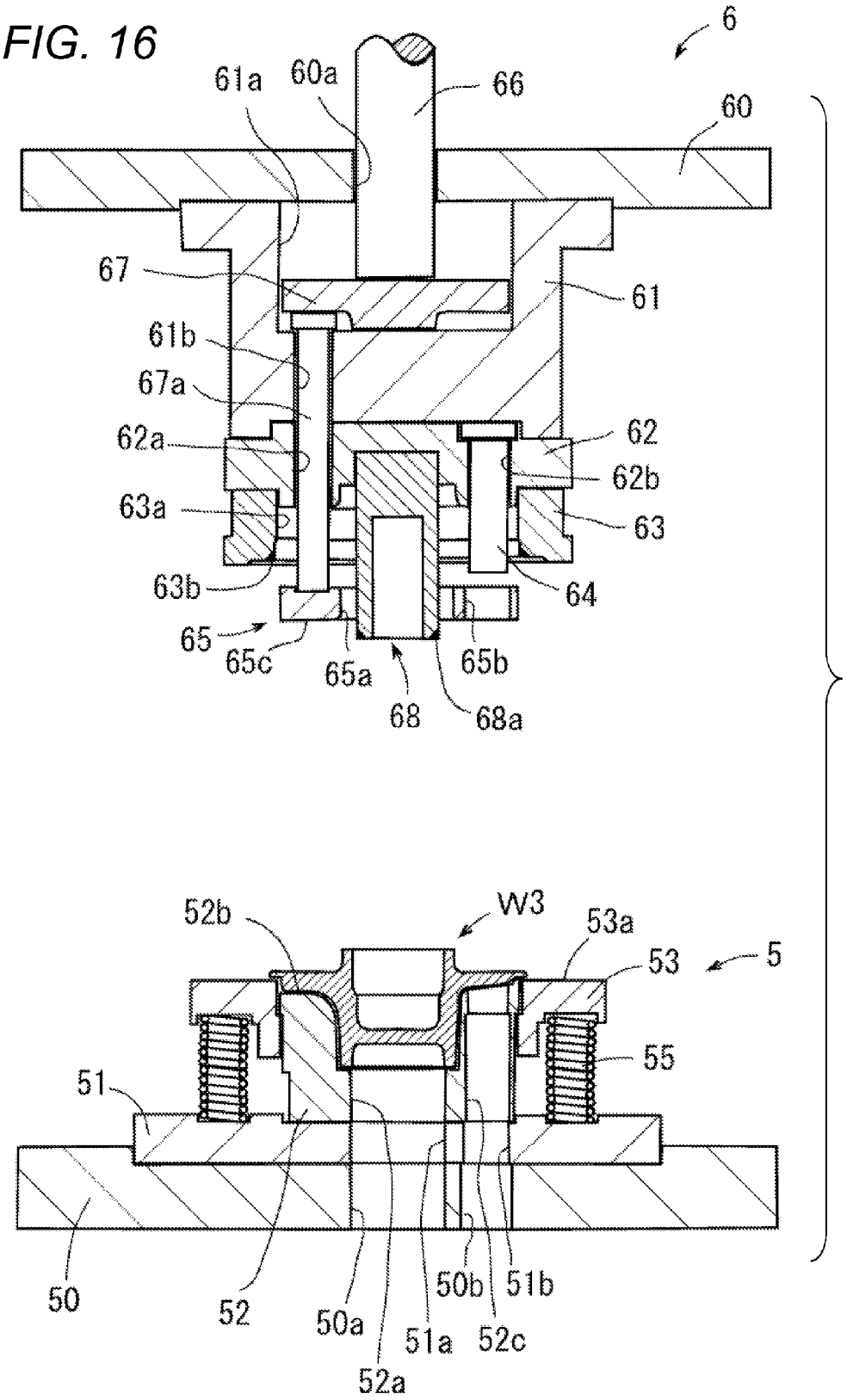
FIG. 16 is a cross-sectional view before dies are closed according to the hot forging press machine of the third embodiment.

FIG. 16 is a cross-sectional view of the hot forging press machine before dies are closed. The hot forging press machine includes a fixed lower die 5 and an upper die 6 vertically movable with respect to the lower die 5. The lower die 5 has a lower base plate 50, a lower plate 51, a lower blade 52, a lower sweeping plate 53, and a spring 55. In the lower base plate 50 constituting the body of the lower die 5, a through hole 50*a* is formed to permit pieces of the punched bottom portion 121*a* of the shaft portion 121 of the intermediate member W3 to fall and a through hole 50*b* is formed to permit pieces of the flange hole 122*b* punched in the flange portion 122 of the intermediate member W3 to fall. To the upper portion of the lower base plate 50, the lower plate 51 is fixed, in which through holes 51*a* and 51*b* are formed both having the same role as the through holes 50*a* and 50*b*. The through holes 50*a* and 51*a* and the through holes 50*b* and 51*b* communicate with each other, respectively.

To the upper portion of the lower plate 51, the lower blade 52 is fixed. The lower blade 52 serves to place the intermediate member W3 thereon and also to remove the burr 123 from underneath. On the upper surface of the lower blade 52, a loading surface 52*b* is formed to place an entirety of the flange portion 122 of the intermediate member W3 thereon. On the loading surface 52*b*, the same shape as the pattern 122*a* is provided concavely. When the dies are closed, the entirety of the flange portion 122 is sandwiched under pressure by the loading surface 52*b* and a pressing surface 65*c* of an upper sweeping plate 65 to be described later. In the lower blade 52 also, a through hole 52*a* which communicates with the through holes 50*a* and 51*a* is formed along with a through hole 52*c* which communicates with the through holes 50*b* and 51*b*.

To the upper portion of the lower blade 52, the lower sweeping plate 53 is slidably fitted on an outer circumference of the lower blade 52. The lower sweeping plate 53 is urged upward by the spring 55. On the upper surface of the lower sweeping plate 53, a loading surface 53*a* is formed to place an entirety of the burr 123 of the intermediate member W3 thereon.

The upper die 6 has an upper base plate 60, an upper blade holder 61, a punching blade holder 62, a deburring upper blade 63, a flange punching blade 64, an upper sweeping plate 65, a press-down rod 66, a stripper plate 67, a stripper pin 67*a*, and a center punching blade 68. In the midsection of the upper base plate 60 constituting the body of the upper die 6, a through hole 60*a* is formed through which the later-described press-down rod 66 is vertically slidable.

Further, to the lower portion of the upper base plate 60, the substantially column-shaped upper blade holder 61 is fixed in which a concave portion 61*a* with an opening opened upward is formed. In the upper blade holder 61, a through hole 61*b* is formed through which the later-described stripper pin 67*a* is vertically slidable. To the lower portion of the upper blade holder 61, the punching blade holder 62 is fixed which has a through hole 62*a* through which the stripper pin 67*a* is vertically slidable and a through hole 62*b* in which the later-described punching blade 64 is housed.

To the lower portion of the punching blade holder 62, the deburring upper blade 63 is fixed. The deburring upper blade 63 is used to remove the burr 123 from the flange portion 122 of the intermediate member W3, performing so-called deburring. The deburring upper blade 63 has a cylindrical shape and has a blade 63*b* at the lower end and the inner circumference of the inner circumferential portion 63*a* thereof. Generally, no step is provided on the inner circumferential portion 63*a*. However, only in a case where it is desired to forcedly add a small round shape (of up to about R3) to the flange portion 122 of the pressed product P3, it is possible to substitute with the deburring upper blade 63 with a round shape (see the round shape 23*c* in FIG. 4 according to the first embodiment) in the vicinity of the blade 63*b*. This round shape may be replaced with a chamfering shape (of up to about C3).

Further, in the through hole 62*b* of the punching blade holder 62, the flange punching blade 64 is housed not to be vertically movable, through the inner circumferential portion 63*a* of the deburring upper blade 63. The flange punching blade 64 is used to punch the flange hole 122*b* in the flange portion 122 of the intermediate member W3, performing so-called punching. To the midsection of the punching blade holder 62, the center punching blade 68 is fixed through the inner circumferential portion 63*a* of the deburring upper blade 63. On the lower end and the outer circumference of the center punching blade 68, a blade 68*a* is formed. The center punching blade 68 is also used to punch the bottom portion 121*a* in the shaft portion 121 of the intermediate member W3, performing so-called punching. Those upper base plate 60, upper blade holder 61, punching blade holder 62, deburring upper blade 63, flange punching blade 64, and center punching blade 68 are integrally configured to be vertically movable without changing their relative positions.

Below the deburring upper blade 63, the upper sweeping plate 65 is provided to be vertically movable. The upper sweeping plate 65 has a substantially cylindrical shape and has an inner circumferential surface 65*a* where part of the shaft portion 121 of the intermediate member W3 is housed and the center punching blade 68 passes through vertically, a through hole 65*b* through which the punching blade 64 passes vertically, and a pressing surface 65*c* formed on the lower end surface thereof. The upper sweeping plate 65 is fixed to the lower end of the stripper pin 67*a* arranged to be vertically slidable through the through hole 61*b* of the upper blade holder 61 and the through hole 62*a* of the punching blade holder 62. This stripper pin 67*a* is pressed downward by the stripper plate 67 arranged to be vertically slidable in the concave portion 61*a*. Further, the stripper plate 67 is pressed downward by the press-down rod 66 vertically slidable through the through hole 60*a*. Consequently, as the press-down rod 66 is pressed downward, the upper sweeping plate 65 is pressed downward. The upper sweeping plate 65 serves to sandwich the entirety of the flange portion 122 under pressure when punching the bottom portion 121*a* of the shaft portion 121 and punching the flange hole 122*b* in and removing the burr 123 of the flange portion 122 of the intermediate member W3 by closing the dies (only when the flange portion 112 has warped. It is to be noted that the entirety of the flange portion 122 may be sandwiched under pressure no matter whether the flange portion 122 has warped or not.) and also serves to press the pressed product P3 downward when discharging the pressed product P3.

The following will describe a method of manufacturing the pressed product P3 from the intermediate member W3 by using the hot forging press machine having the mechanical configuration described above. First, as shown in FIG. 16, the intermediate member W3 is set to the hot forging press machine before the dies are closed. At this time, an entirety of the surface of the flange portion 122 of the intermediate member W3 should be securely abut against the loading surface 52*b*. The pattern 122*a* is provided convexly on the flange portion 122 and the same pattern as the pattern 122*a* is provided concavely on the loading surface 52*b*, so that it is possible to easily make the entirety of the surface of the flange portion 122 of the intermediate member W3 abut against the loading surface 52*b*.

Figure 17:
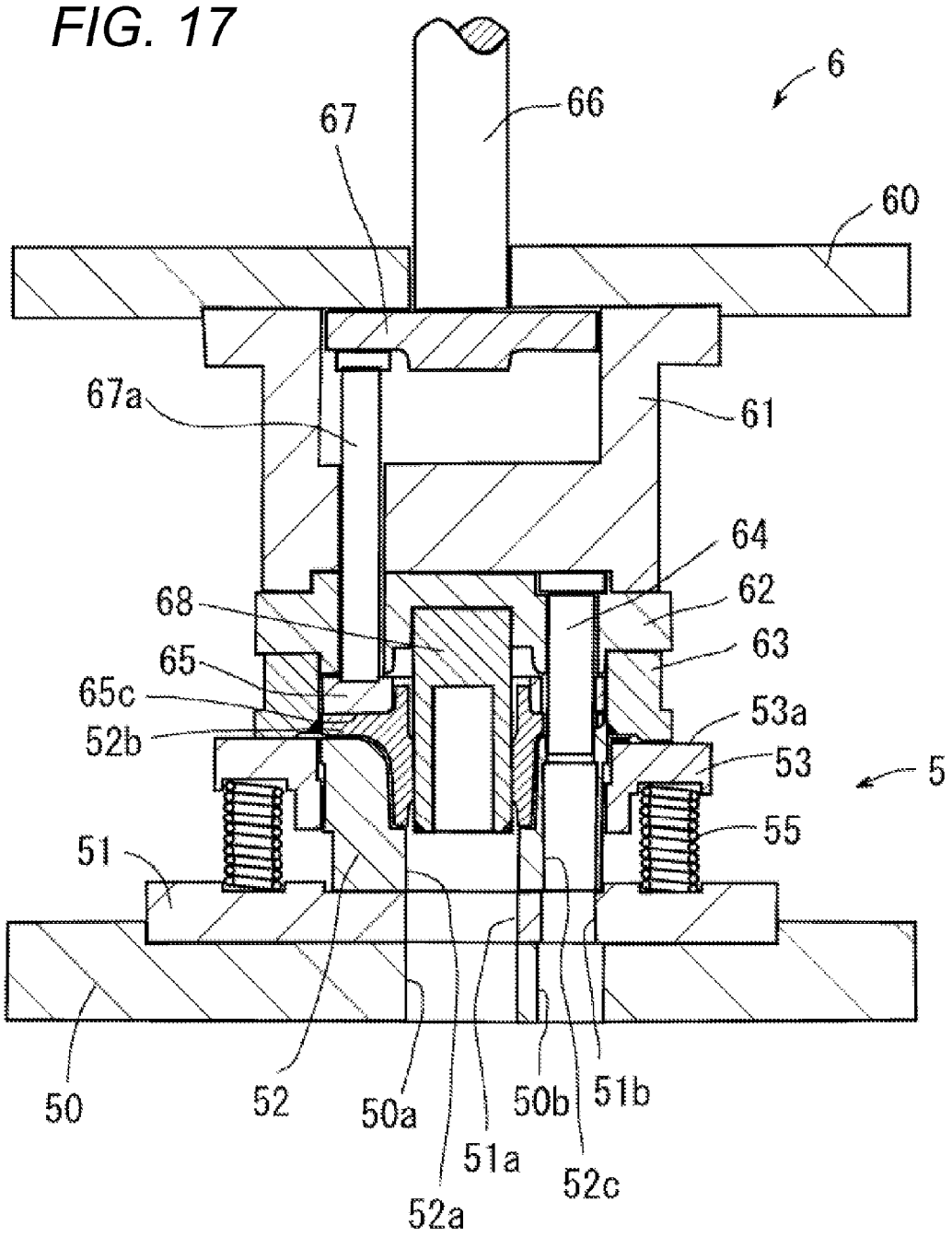
FIG. 17 is a cross-sectional view when the dies are closed according to the hot forging press machine of the third embodiment.

When the upper die 6 is moved downward to close the dies, as shown in FIG. 17, the bottom portion 121*a* is punched in the flange portion 121 of the intermediate member W3 by the center punching blade 68 (punching) and the flange hole 122*b* is punched in the flange portion 122 by the flange punching blade 64 (punching) and the burr 123 of the flange portion 122 is removed by the deburring upper blade 63 (deburring). At this time, when the flange portion 122 has warped, the entirety of the flange portion 122 is sandwiched under pressure by the loading surface 52*b* and the pressing surface 65*c*. Then, pieces of the punched bottom portion 121*a* are permitted to fall through the through holes 52*a*, 51*a*, and 50*a*. Further, pieces of the punched flange hole 122*b* are permitted to fall through the through holes 52*c*, 51*b*, and 50*b*, while the burr 123 is placed on the loading surface 53*a* under pressure.

Figure 18:
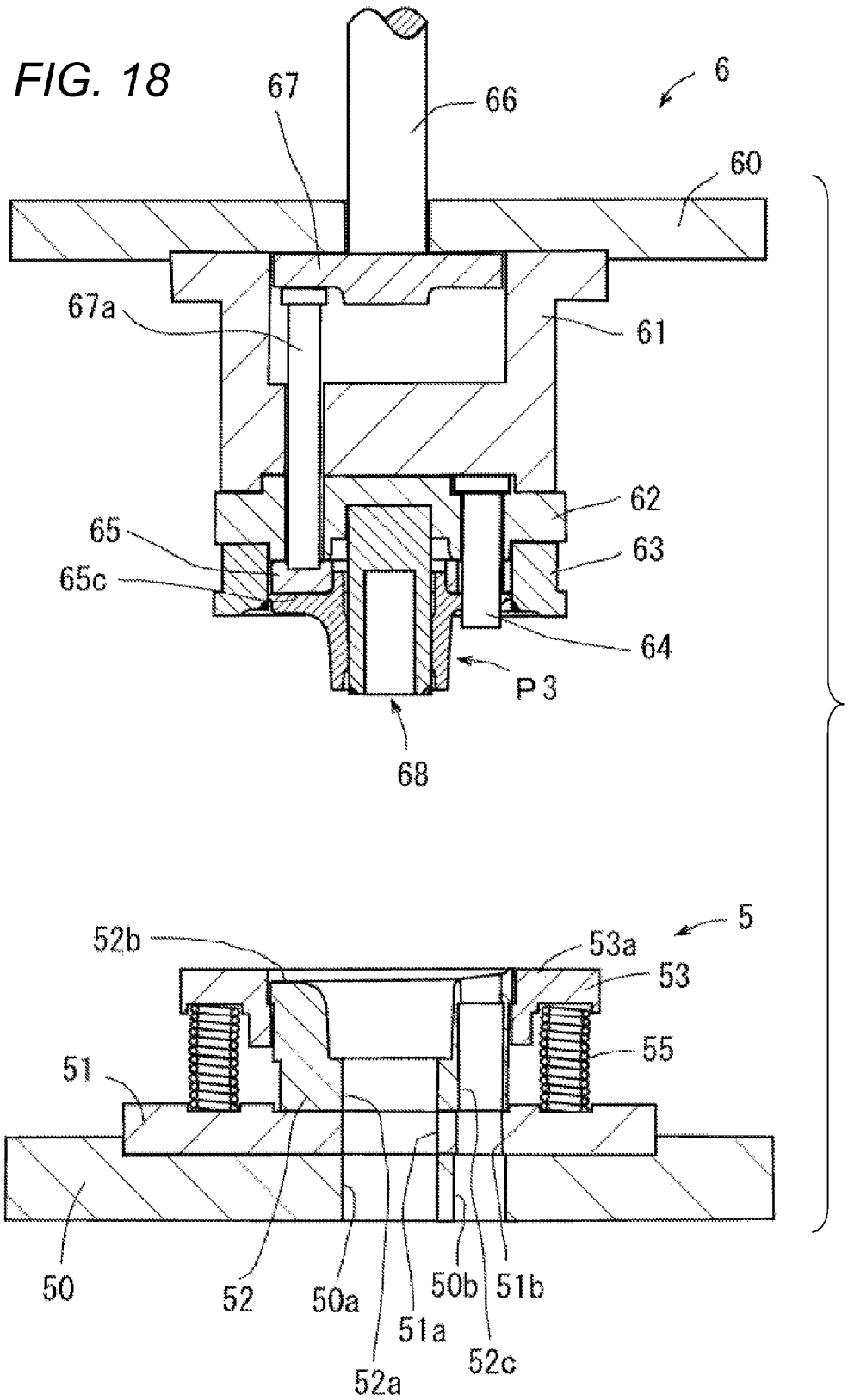
FIG. 18 is a cross-sectional view when the dies are opened according to the hot forging press machine of the third embodiment.

When the upper die 6 is moved upward to open the dies, as shown in FIG. 18, the pressed product P3 moves upward along with the upper die 6. Then, the burr 123 is blown off from the loading surface 53*a* by air.

Figure 19:
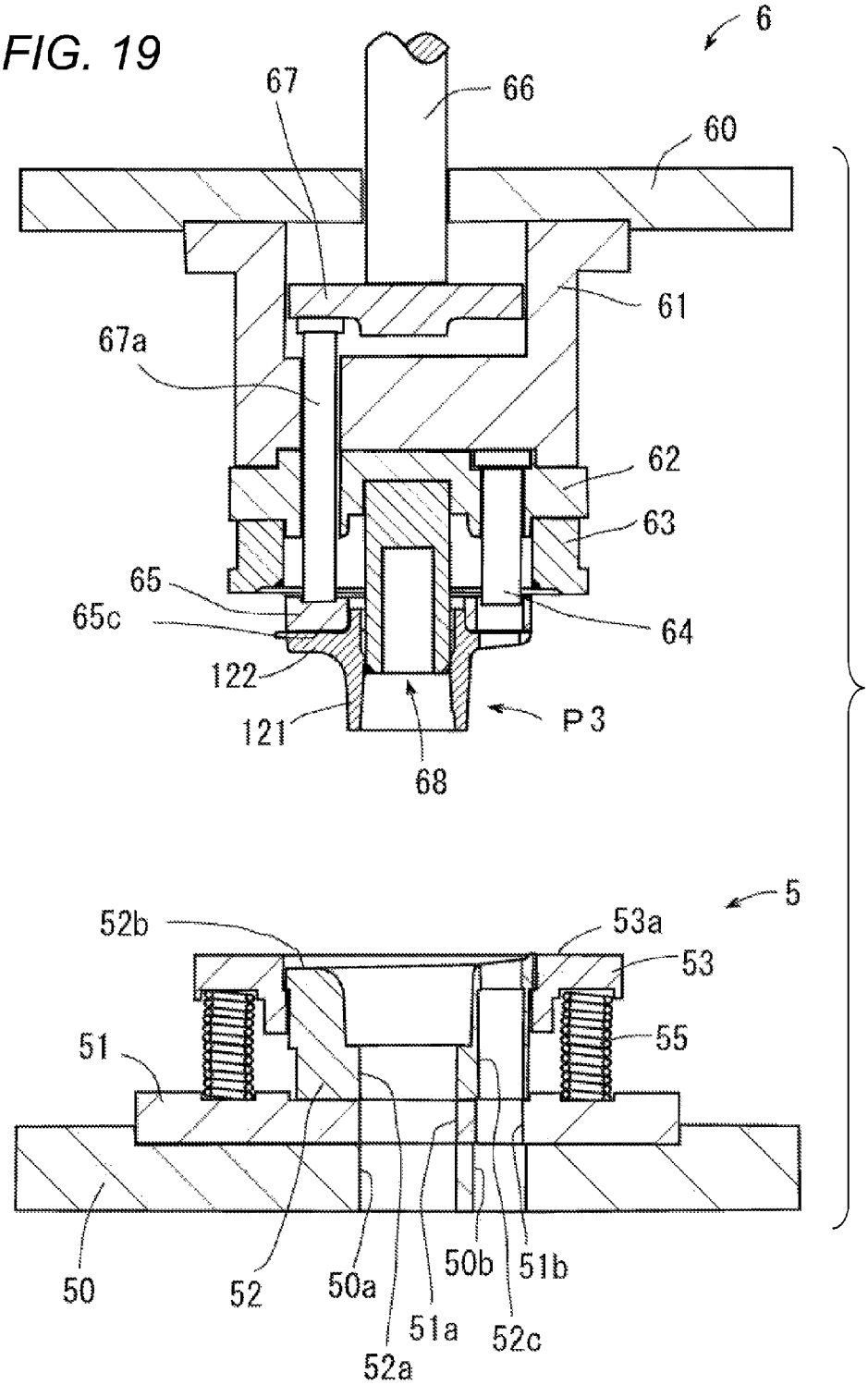
FIG. 19 is a cross-sectional view when the pressed product is discharged according to the hot forging press machine of the third embodiment.

Further, as shown in FIG. 19, the press-down rod 66 is pressed downward to thereby press the upper sweeping plate 65 downward. Consequently, the pressed product P3 is pressed downward and discharged from the upper die 6. At this time, the entirety of the flange portion 122 is pressed downward by the pressing surface 65*c*.

Like the first and second embodiments, in the hot forging press machine of the third embodiment, since the intermediate member W3 is set to the lower blade 52 of the lower die 5 and then the deburring upper blade 63 is lowered from above to perform deburring, the flange portion 122 does not easily have burrs on the upper surface thereof. This will eliminate the need of deburring the pressed product P3. That is, since burrs are removed from above, burrs are not likely to occur on an upper end portion of the deburred surface of the pressed product. Therefore, this will greatly mitigate the finishing of the upper end portion in the post-process, and improve productivity. In the conventional hot forging press machines, since the deburring blade is fixed to the lower die and the intermediate member W3 is lowered from above to perform deburring, the flange portion 122 have burrs on the upper surface thereof.

In the present hot forging press machine, since punching and deburring are performed simultaneously, punching can be carried out in one process. In particular, it is effective that the present hot forging press machine performs a total of three operations of punching the bottom portion 121*a*, punching the flange hole 122*b*, and removing the burr 123 in one process. Moreover, in the present hot forging press machine, when there is a possibility that the flange portion 122 of the pressed product P3 may warp, the entirety of the flange portion 122 of the intermediate member W3 is sandwiched under pressure by the loading surface 52*b* and the pressing surface 65*c* to perform punching and deburring. Therefore, the flange portion 122 of the pressed product P3 does not easily warp. Consequently, according to the hot forging press machine of the third embodiment, it is possible to precisely perform punching and deburring simultaneously. Like the first and second embodiments, since the flange portion 122 of the pressed product P3 does not easily warp, it need not have a large machining allowance at the time of pressing nor be flattened forcedly after pressing.

In the present hot forging press machine, generally, no step is provided on the inner circumferential portion 63*a*. However, only in a case where it is desired to forcedly add a small round shape (of up to about R3) to the flange portion 122 of the pressed product P3, it is possible to substitute with the deburring upper blade 63 with a round shape in the vicinity of the blade 63*b*. In this case, the pressed product P3 is forcedly provided with the small round shape. Therefore, the flange portion 122 of the pressed product P3 need not be chamfered.

Moreover, in the present hot forging press machine, the pressed product P3 is discharged from the upper die 6 by pressing the entirety of the upper surface of the flange portion 122 of the pressed product P3 with the upper sweeping plate 65. Therefore, the flange portion 122 does not easily warp.

Although the hot forging press machine of the embodiment of the present invention has been described with reference to the first through third embodiments, the invention is not limited to this and, of course, can be appropriately modified and applied as far as not departing from the technological gist of the invention.

A hot forging press machine according to a first aspect of the embodiment has a fixed lower die, a vertically movable upper die, a punching blade for punching, and a deburring blade including a deburring upper blade and a deburring lower blade to perform deburring. The hot forging press machine manufactures a pressed product by hot forging from an intermediate member having a solid shaft portion and a flange portion projecting in a radially outward direction from the shaft portion, specifically, by performing deburring by setting the intermediate member in the lower die and lowering the deburring upper blade, opening the dies to move the pressed product upward along with the upper die until it is discharged from this upper die, and simultaneously performing punching and deburring in condition where an entirety of the flange portion of the intermediate member can be sandwiched under pressure by the lower die and the upper die. The punching involves punching of the shaft portion and/or punching of the flange portion. The deburring upper blade is fixed to a lower portion of the upper die and the lower blade is fixed to an upper portion of the lower die. Further, a lower sweeping plate urged upward by a spring is slidably fitted to an outer circumference of the lower blade to perform deburring and an upper sweeping plate of the upper die presses an entirety of an upper surface of the flange portion of the pressed product to perform the discharging.

The hot forging press machine according to a second aspect of the embodiment may further have a spring arranged in a through hole of the upper die and a vertically slidable deburring pin arranged at a lower end of the spring. When the dies are closed, burrs are removed from the flange portion by the deburring upper blade and are placed under pressure on a loading surface of the lower die by the deburring pin, and when the dies are opened, the lower sweeping plate is urged to press up the burrs to perform deburring.

In the hot forging press machine according to a third aspect of the embodiment, the upper die may include an upper base plate, a substantially column-shaped upper blade holder fixed to a lower portion of the upper base plate and having a concave portion with an opening opened upward, a substantially cylindrical deburring upper blade holder fixed to an outer circumference of the upper blade holder and having an inner circumferential surface, the deburring upper blade fixed to a lower portion of the deburring upper blade holder to remove the burrs from the flange portion of the intermediate member, a center punching blade and/or a flange punching blade both fixed to the lower portion of the upper blade holder to punch the shaft portion and/or the flange portion in the intermediate member, respectively, the spring arranged in the through hole formed in the upper blade holder, and the vertically slidable deburring pin arranged at the lower end of the spring; the lower die includes a lower base plate, a lower plate fixed to an upper portion of this lower base plate, and the lower blade fixed to the lower plate; the lower sweeping plate is slidably fitted to an upper portion of the lower blade at its outer circumference and urged upward by the spring; when the dies are closed, the burrs are removed from the flange portion by the deburring upper blade and placed under pressure on a loading surface of the lower die; when the dies are opened, the lower sweeping plate is urged to press up the burrs; and the burrs are blown off by air from the loading surface to perform deburring.

In the hot forging press machine according to a fourth aspect of the embodiment, the vicinity of a cutting edge of the deburring blade is formed into a round shape.

In the hot forging press machine according to the first aspect of the embodiment, since burrs are removed by setting the intermediate member in the lower die and lowering the deburring upper blade, burrs do not easily occur on the upper surface at a deburring position. This will eliminate the need of deburring the pressed product. That is, by cutting off the burrs from above, the burrs do not occur at the upper end portion of a burr cutting surface of the pressed product. Therefore, finishing work on the upper end portion in a post-process is greatly reduced, thereby improving productivity.

Further, in the hot forging press machine according to the first aspect of the embodiment, since punching and deburring are performed simultaneously, punching can be carried out in one process. Moreover, according to this hot forging press machine, punching and deburring are performed in a manner such that the entirety of the flange portion of the intermediate member is sandwichable by the lower die and the upper die under pressure. Accordingly, when there is a possibility that the flange portion may warp, punching and deburring can be performed by sandwiching the entirety of the flange portion by the lower die and the upper die under pressure. Further, even when there is no possibility that the flange portion may warp, punching and deburring can still be performed by sandwiching the entirety of the flange portion by the lower die and the upper die under pressure. Therefore, the hot forging press machine of the present invention can precisely perform punching and deburring simultaneously. Since the flange portion of the pressed product does not easily warp, it need not have a large machining allowance at the time of pressing nor be flattened forcedly after pressing.

The punching involves punching of the shaft portion and/or punching of the flange portion. Consequently, there are three patterns: punching and deburring of the shaft portion, punching and deburring of the flange portion, and punching of the shaft portion as well as punching and deburring of the flange portion.

The deburring upper blade is fixed to the lower portion of the upper die and the lower blade is fixed to the upper portion of the lower die and, further, the lower sweeping plate urged upward by the spring is slidably fitted to the outer circumference of the lower blade to perform deburring. Therefore, burrs are securely cut off from the pressed product and placed on the loading surface.

Further, by cutting off the burrs from above, since the burrs do not occur at the upper end portion of the burr cutting surface of the pressed product, finishing work on the upper end portions in the post-process is reduced greatly, thereby improving productivity.

Moreover, the pressed product is discharged by pressing the entirety of the upper surface of the flange portion of the pressed product and, therefore, does not easily warp.

Since the hot forging press machine according to the second aspect of the embodiment further has the spring arranged in the through hole of the upper die and the vertically slidable deburring pin arranged at the lower end of the spring, burrs are more securely cut off from the pressed product and placed on the loading surface.

The hot forging press machine according to the third aspect of the embodiment includes the upper blade holder fixed to the lower portion of the upper base plate, the deburring upper blade holder fixed to the outer circumference of the upper blade, the deburring upper blade fixed to the lower portion of the deburring upper blade holder, and the center punching blade fixed to the lower portion of the upper blade holder and/or the flange punching blade used to punch the flange portion. Therefore, the upper base plate, the upper blade holder, the deburring upper blade holder, the deburring upper blade, and the center punching blade and/or the flange punching blade are integrally configured to be vertically movable without changing their relative positions. Thus, it is possible to securely perform punching and deburring simultaneously.

In addition, the press machine according to the third aspect of the embodiment further includes the spring arranged in the through hole formed in the upper blade holder and the vertically slidable deburring pin arranged to the lower end of the spring, so that it is possible to more effectively cut off burrs from the pressed product and place them on the loading surface.

Furthermore, the burrs are placed by the deburring pin on the loading surface of the lower die under pressure. When the dies are opened, the lower sweeping plate is urged to press up the burrs. Then, burrs are blown off by air from the loading surface, thereby performing deburring effectively.

In the hot forging press machine according to the fourth aspect of the embodiment, the vicinity of the cutting edge of the deburring blade is formed into a round shape. Generally, no step is provided in the vicinity of the cutting edge of the deburring blade. However, there are some cases where it is desired to forcedly add a round shape to a portion of the pressed product to be deburred. In such a case, it is possible to substitute a deburring blade with a round shape formed in the vicinity of its cutting edge. In this case, since the pressed product is forcedly provided with the round shape, its deburring portion need not be chamfered. In place of a round shape, a chamfering shape may be added.

Obviously, numerous modifications and variations of the present invention are possible in light of the above teachings. It is therefore to be understood that within the scope of the appended claims, the invention may be practiced otherwise than as specifically described herein.

What is claimed is:

1. A hot forging press machine comprising;

a fixed lower die, a vertically movable upper die, a punching blade for punching, and a deburring blade including a deburring upper blade and a deburring lower blade to perform deburring, and manufacturing a pressed product by hot forging from an intermediate member having a solid shaft portion and a flange portion projecting in a radially outward direction from the shaft portion, specifically, by performing deburring by setting the intermediate member in the lower die and lowering the deburring upper blade, opening the dies to move the pressed product upward along with the upper die until it is discharged from this upper die, and simultaneously performing punching and deburring in condition where an entirety of the flange portion of the intermediate member can be sandwiched under pressure by the lower die and the upper die, wherein:

the punching involves punching of the shaft portion and/or punching of the flange portion;

the deburring upper blade is fixed to a lower portion of the upper die and the lower blade is fixed to an upper portion of the lower die;

a lower sweeping plate urged upward by a spring is slidably fitted to an outer circumference of the lower blade to perform deburring and an upper sweeping plate of the upper die presses an entirety of an upper surface of the flange portion of the pressed product to perform the discharging;

the upper die includes an upper base plate, a substantially column-shaped upper blade holder fixed to a lower portion of the upper base plate and having a concave portion having an opening opened upward formed therein, a substantially cylindrical deburring upper blade holder fixed to an outer circumference of the upper blade holder and has an inner circumferential surface, the deburring upper blade fixed to a lower portion of this deburring upper blade holder in order to remove the burrs from the flange portion of the intermediate member, a center punching blade and/or a flange punching blade both fixed to the lower portion of the upper blade holder in order to punch the shaft portion and/or the flange portion in the intermediate member, respectively, a spring arranged at the through hole formed in the upper blade holder, and a vertically slidable deburring pin arranged to the lower end of the spring;

the lower die includes a lower base plate, a lower plate fixed to an upper portion of the lower base plate, and the lower blade fixed to the upper portion of the lower plate; and the lower sweeping plate is slidably fitted to an upper portion of the lower blade at its outer circumference and urged upward by the spring;

when the dies are closed, the burrs are removed from the flange portion by the deburring upper blade and placed under pressure on a loading surface of the lower die;

when the dies are opened, the lower sweeping plate is urged to press up the burrs; and the burrs are blown off by air from the loading surface, to perform deburring.

2. The hot forging press machine according to claim 1, wherein the vicinity of a cutting edge of the deburring blade is formed into a round shape.

* * * * *